US008505788B2

(12) United States Patent
Thibault

(10) Patent No.: US 8,505,788 B2
(45) Date of Patent: Aug. 13, 2013

(54) DETACHABLE HANDLE FOR A PORTABLE PAINT AND BRUSH CONTAINER

(76) Inventor: Richard R. Thibault, Shelby Township, MI (US)

( * ) Notice: Subject to any disclaimer, the term of this patent is extended or adjusted under 35 U.S.C. 154(b) by 483 days.

(21) Appl. No.: 12/765,173

(22) Filed: Apr. 22, 2010

(65) Prior Publication Data

US 2011/0259891 A1 Oct. 27, 2011

(51) Int. Cl.

| | |
|---|---|
| ***B44D 3/14*** | (2006.01) |
| ***A45F 5/00*** | (2006.01) |
| ***A46B 17/02*** | (2006.01) |

(52) U.S. Cl.

USPC ..... 224/148.7; 224/148.4; 224/183; 224/666; 224/904; 220/769; 16/425; 294/34

(58) Field of Classification Search

USPC ..... 224/148.4, 148.7, 183, 251, 271–272, 224/665–666, 671, 904; 248/206.5, 225.11; 220/759, 769–770; 16/425; 294/30, 31.1, 294/34

See application file for complete search history.

(56) References Cited

U.S. PATENT DOCUMENTS

| | | | | |
|---|---|---|---|---|
| 730,731 | A * | 6/1903 | Abercrombie | 220/759 |
| 1,109,161 | A | 9/1914 | Chindgren | |
| 1,292,728 | A | 1/1919 | Dozier | |
| 2,010,317 | A | 8/1935 | Olson | |
| 2,262,273 | A * | 11/1941 | Ferrara | 294/27.1 |
| 2,367,256 | A | 1/1945 | Atkins | |
| 2,487,516 | A | 11/1949 | Braswell | |
| 2,498,511 | A * | 2/1950 | Smith | 211/65 |
| 2,613,860 | A | 10/1952 | Hoffman | |
| 2,625,299 | A | 1/1953 | Uhlig | |
| 2,639,502 | A | 5/1953 | Wormelle | |
| 2,648,900 | A | 8/1953 | Anderson | |
| 2,756,913 | A | 7/1956 | Oswald | |
| 2,786,707 | A * | 3/1957 | Campbell | 294/34 |
| 2,788,153 | A * | 4/1957 | Broadbelt | 220/695 |
| 2,808,285 | A | 10/1957 | Robuck | |
| 2,905,500 | A | 9/1959 | Thombs | |
| 2,985,349 | A | 5/1961 | McGuire | |
| 2,988,786 | A | 6/1961 | Hill | |
| 2,995,281 | A | 8/1961 | Dixon | |
| 3,024,057 | A | 3/1962 | Lockwood | |
| 3,076,223 | A * | 2/1963 | Reichold | 16/425 |
| 3,186,026 | A * | 6/1965 | Serio | 220/759 |
| 3,189,937 | A | 6/1965 | Sciortino | |
| 3,232,657 | A * | 2/1966 | Thompson et al. | 294/31.1 |
| 3,261,635 | A | 7/1966 | Talay | |
| 3,269,765 | A * | 8/1966 | Pryce | 294/31.1 |
| 3,304,112 | A * | 2/1967 | Elliott | 294/34 |

(Continued)

*Primary Examiner* — Nathan J Newhouse
*Assistant Examiner* — John Cogill
(74) *Attorney, Agent, or Firm* — The Dobrusin Law Firm, P.C.

(57) ABSTRACT

The invention is an ergonomic detachable handle having a grip portion terminating at one end in a contoured band for carrying a paint container and associated brush. The contoured band has a cantilevered support portion with an upstanding peripheral edge for receiving the lip of a container. A spring biased retainer clip is mounted to the cantilevered support portion so that the slidable movement of the spring biased retainer clip traps the lip of the container between the upstanding peripheral edge of the cantilevered support portion and the spring biased retainer clip to securely hold the container to the grip portion of the handle. A shell housing dependent from the cantilevered support portion houses a permanent magnet in contact with the wall of the container to hold a painter's brush magnetically against the magnet on the inside of the container.

20 Claims, 5 Drawing Sheets

(56) References Cited

U.S. PATENT DOCUMENTS

| | | | | | |
|---|---|---|---|---|---|
| 3,425,012 | A | | 1/1969 | Gottinger | |
| 3,493,152 | A | | 2/1970 | Ort | |
| 3,536,285 | A | | 10/1970 | Vaughn | |
| 3,729,158 | A | | 4/1973 | Nagy | |
| 3,743,147 | A | | 7/1973 | Wilczynski | |
| 3,797,717 | A | | 3/1974 | Collins | |
| 3,878,589 | A | | 4/1975 | Schaefer | |
| 3,948,413 | A | * | 4/1976 | Gorrell et al. | 220/696 |
| 4,101,046 | A | | 7/1978 | Puntillo | |
| 4,106,679 | A | | 8/1978 | Hillinger | |
| 4,172,542 | A | | 10/1979 | Lankford | |
| 4,183,444 | A | | 1/1980 | English | |
| 4,275,818 | A | | 6/1981 | Church | |
| 4,325,503 | A | | 4/1982 | Swinney | |
| 4,363,433 | A | | 12/1982 | Jaques | |
| 4,433,801 | A | | 2/1984 | Swinney | |
| 4,436,217 | A | | 3/1984 | Ritter | |
| D276,760 | S | | 12/1984 | Kesterson | |
| 4,527,720 | A | | 7/1985 | Hayes | |
| 4,605,335 | A | | 8/1986 | Otrusina | |
| D286,949 | S | | 12/1986 | Hardman | |
| 4,708,273 | A | | 11/1987 | Grant | |
| 4,718,586 | A | | 1/1988 | Hagino | |
| 4,746,042 | A | | 5/1988 | King | |
| 4,860,891 | A | | 8/1989 | Biggio | |
| 4,927,046 | A | | 5/1990 | Armstrong | |
| D313,296 | S | * | 12/1990 | Abbey | D32/54 |
| 4,974,764 | A | | 12/1990 | Cantwell | |
| 5,016,791 | A | | 5/1991 | Burrow | |
| 5,054,170 | A | | 10/1991 | Otrusina | |
| 5,083,733 | A | | 1/1992 | Marino | |
| 5,145,226 | A | * | 9/1992 | LaFontaine | 294/27.1 |
| 5,203,471 | A | * | 4/1993 | Widman | 220/755 |
| 5,232,137 | A | * | 8/1993 | Devine | 224/666 |
| 5,329,670 | A | | 7/1994 | Huang | |
| 5,377,863 | A | | 1/1995 | Widman | |
| 5,489,051 | A | | 2/1996 | Robinson | |
| 5,490,618 | A | | 2/1996 | Davidson | |
| 5,497,921 | A | | 3/1996 | Dancyger | |
| 5,549,216 | A | | 8/1996 | Scholl | |
| 5,584,520 | A | | 12/1996 | Niemeier | |
| 5,687,873 | A | | 11/1997 | Jones | |
| 5,730,339 | A | | 3/1998 | Stolfo | |
| RE35,933 | E | | 10/1998 | Scholl | |
| 5,839,173 | A | | 11/1998 | Otrusina | |
| 5,915,606 | A | | 6/1999 | Jensen | |
| 5,943,696 | A | | 8/1999 | Walker | |
| 6,006,966 | A | | 12/1999 | Voisin, Jr. | |
| 6,027,152 | A | | 2/2000 | Sawdey | |
| 6,045,017 | A | | 4/2000 | Connell | |
| 6,102,458 | A | | 8/2000 | Scace | |
| 6,138,963 | A | | 10/2000 | Malvasio | |
| 6,179,143 | B1 | * | 1/2001 | Grob | 215/398 |
| 6,283,345 | B1 | | 9/2001 | Butschat | |
| 6,394,304 | B1 | | 5/2002 | Bohne et al. | |
| 6,457,616 | B2 | * | 10/2002 | Gagne | 224/148.4 |
| 6,557,738 | B1 | | 5/2003 | Meintzer | |
| D480,555 | S | | 10/2003 | Bledsoe | |
| 6,658,701 | B1 | | 12/2003 | DeHart | |
| 6,708,838 | B2 | | 3/2004 | Bergman et al. | |
| 6,719,178 | B1 | | 4/2004 | Taylor | |
| 6,866,172 | B2 | | 3/2005 | Shackelford | |
| 6,871,825 | B2 | * | 3/2005 | Song | 248/113 |
| D507,105 | S | | 7/2005 | Armstrong | |
| 6,929,225 | B1 | | 8/2005 | Kent | |
| 6,991,829 | B2 | | 1/2006 | Bergman | |
| D518,263 | S | | 3/2006 | Verhaar | |
| 7,191,913 | B2 | | 3/2007 | Byrne | |
| D549,913 | S | | 8/2007 | Bergman | |
| 7,543,726 | B2 | | 6/2009 | MacNaughton | |
| 7,588,225 | B2 | | 9/2009 | Wawerski | |
| 7,604,270 | B1 | | 10/2009 | McCarthy | |
| 7,748,583 | B1 | * | 7/2010 | Woltman | 224/251 |
| 7,959,030 | B2 | * | 6/2011 | Bergman | 220/769 |
| 2003/0160075 | A1 | * | 8/2003 | Musarella et al. | 224/269 |
| 2004/0195280 | A1 | * | 10/2004 | Shackelford | 224/148.7 |
| 2007/0068948 | A1 | * | 3/2007 | Friedman | 220/501 |
| 2007/0114351 | A1 | * | 5/2007 | Mitchell | 248/311.2 |
| 2008/0054030 | A1 | * | 3/2008 | Diaz | 224/148.7 |
| 2008/0110910 | A1 | * | 5/2008 | Kleppin | 220/759 |
| 2010/0044405 | A1 | * | 2/2010 | Albert | 224/666 |

* cited by examiner

DETACHABLE HANDLE FOR A PORTABLE PAINT AND BRUSH CONTAINER

CROSS-REFERENCES TO RELATED APPLICATIONS

Not applicable.

FEDERALLY SPONSORED RESEARCH OR DEVELOPMENT

Not applicable.

REFERENCE TO A MICROFICHE APPENDIX

Not applicable.

BACKGROUND OF THE INVENTION

1. Field of the Invention

The present invention relates to a detachable handle for containers and more specifically to a detachable handle that supports a paint container and a paint brush in any plurality of applications in a safe, ergonomically convenient, and economical manner.

2. Description of the Prior Art

A painter, whether a do-it-yourselfer or a professional tradesman has to carry around the room a container containing the paint material for considerable time periods in order to accomplish the task of cutting in the four walls of each room including base board trim or to finish paint wood trim or any form of decorative trim including finish painting of doors and window frames. While in some instances, the workman can set the paint can down during painting; in other situations such as touching up of numerous small areas which may be scattered around a room, a tradesman may desire to hold the paint can during painting.

To facilitate holding or transporting a paint can by a user, conventional one gallon paint containers are generally equipped with a semi-circular wire handle pivotally connected at respective ends to diametrically opposed outside surfaces of the one gallon paint container.

Since the weight of a full one gallon paint container is approximately eight pounds, manually holding a paint can by its wire handle during painting operations is uncomfortable as well as fatiguing as the narrow wire handle causes considerable localized stress on a user's curled fingers, especially when the one gallon paint container is full. More importantly, it is ergonomically unacceptable to expect a tradesman or do-it-yourselfer to hold in one hand, for considerable time periods, an eight pound gallon can in order to accomplish the cutting in of four walls of a room including base boards trim or to finish paint wood trim or any form of decorative trim including finish painting of doors or window frames.

Some users, in order to provide better access to a manually held paint can, will rotate the wire handle downwards from the upright position to near its storage position, and then curl their thumb of one hand over the wire handle and support the underside of the one gallon paint can with the fingers of that hand. This holding technique is also very uncomfortable as well as causes a great deal of muscle fatiguing in the hand supporting the paint container.

Because of this well known problem, the prior art is replete with detachable handles for use with a standard one gallon paint can. Very few of these prior art references give any consideration to the precarious terrain such as newly constructed homes as well as working on a ladder or a scaffold.

Further, many of the prior art solutions to the well known problem completely disregard the ergonomic requirements of today's workplace, that is a completely efficient work system which results in improved productivity and employee satisfaction, health, safety, and commitment.

Some of the proposed solutions by the prior art to this well known problem propose ergonomic solutions to this problem but fail to take into consideration the extent of the problem especially to a professional painter or tradesman. For example, U.S. Pat. No. 5,584,520 to Niemeier discloses an ergonomic can carrier for allowing a person to transport and hold a container, such as a can of paint, in a comfortable fashion while simultaneously allowing ready access to the container contents with little likelihood of spillage. The invention includes a body, a first support component, and a handle. The first support component is connected to the body and operationally engages either the top or bottom of the container. The second support component is movably mounted to the body and shiftable between a retracted position and an operational position. When in the operational position, the second support component engages the other of the container top and bottom when the first support component operationally engages one of the container top and bottom to thereby hold the container therebetween. The handle extends from the body and is ergonomically structured and arranged relative to the body to be graspable within a hand of the apparatus user while the container is held in a generally upright orientation between the first and second support components to prevent spillage of the spillable material through the container top opening.

Although the Niemeier ergonomic can carrier may provide some ergonomic considerations, its shortcomings are clearly recognizable. The invention avoids carrying the eight pound paint can by the wire handle or bail but the weight of the contents of the one gallon paint can exceeds an acceptable safe weight for long term carrying of the device in one hand while doing touch-ups. Also, how do you safely handle this device on a ladder or scaffold since the paint can, can no longer sit on a flat surface with the ergonomic handle attached thereto.

Sawdey, U.S. Pat. No. 6,027,152 also proposes an ergonomic carrying device for transporting containers containing materials such as paint. Again, such carrier is completely unsuitable for a painting professional in the performance of his normal job activities for the same reasons as stated above. Lastly, the ergonomic paint can holder disclosed by Bohne et al. in U.S. Pat. No. 6,394,304 is nothing more than a lightweight plastic structurally reinforced can holder to hold a partially filled paint can that is used for trimming out walls and ceilings. No consideration was given to using the holder while standing on a ladder or scaffold.

While the devices of the prior art may be suitable for the specific purposes which they address, they are not suitable for use in today's workplace. Accordingly, there is a great need for a hand-held container for use by a professional painter or tradesman that may be easily and safely gripped without the need for making adjustments, that maintains a substantially vertical position regardless of the position of the painter, i.e., bending position, climbing a ladder, or that requires the user to utilize one hand to hold the container while climbing a ladder or reaching to cover a hard to access surface which needs coverage, i.e., overhangs, under eaves, etc.

Accordingly, there exists a need for an ergonomically convenient, light weight, comfortable, efficient, and economical device for carrying, holding, and transferring liquids such as paint. In addition, such new device requires a convenient and secure resting place for a paint brush, as will become apparent from the description that follows.

SUMMARY OF THE INVENTION

The invention is a detachable handle for carrying a paint container and associated brush that addresses some of the problems associated with the prior art containers proposed for use by a tradesman in the field of painting. The overall objective is to propose an optimum paint container for carrying out a task of painting in any given workplace so as to improve productivity, tradesman's satisfaction, health, safety, and commitment.

With this general objective in mind, the proposed invention is, in general, a container with an ergonomic detachable magnetic handle for holding paint material and an associated brush which is particularly useful for painters, and is not anticipated or rendered obvious by any of the prior art considered alone or in combination thereof.

The present invention consists of an ergonomic handle having a grip portion terminating at one end in a contoured band. The contoured band has a cantilevered support portion with an upstanding peripheral edge for receiving the lip of a container thereon. The cantilevered support portion and contoured band of the handle further have a spring biased retainer clip mounted thereon. The spring biased retainer clip is slidably moveable with respect to the upstanding peripheral edge so that the slidable movement of the spring biased retainer clip traps the lip of the container between the upstanding peripheral edge of the cantilevered support portion and the spring biased retainer clip to securely hold the container to the grip portion of the handle. A cam lock is also mounted to the contoured band. The cam lock is rotatably attached to the contoured band to maintain the spring biased retainer clip locked to the lip of the container. The cantilevered support portion terminates with a shell housing having a chamber to receive a permanent magnet. The permanent magnet, when mounted in the shell housing and the handle securely attached to the container, is in contact with the wall of the container so that a painter's brush can be magnetically stored against the magnet on the inside of the container.

The container itself can be of any configuration, size, or shape as long as it has a peripheral lip such that the lip of the container can be mounted to the upstanding peripheral edge of the cantilevered support portion and trapped by the spring biased retainer clip to be securely attached to the handle.

Accordingly, it is a principal object of the invention to provide a paint can holder for carrying out a task of painting in any given workplace so as to improve productivity, tradesman's satisfaction, health, safety, and commitment.

It is another object of the invention to provide an apparatus for carrying a container that holds spillable material that utilizes an attachable handle which is ergonomically structured and arranged to be held by a user with one hand while the container is held in a generally upright orientation to prevent spillage of the spillable material through the container top opening.

It is yet another object of the invention to provide an ergonomic can carrier that is comfortable to grip, and that a user can carry around to a job site with minimal hand fatigue or discomfort.

Still another object of the invention is to provide a paint can carrier that can conveniently be attached to the belt of a painter while going up or down a ladder or while performing trim work without any spillage.

Still a further object of the invention is to provide a paint carrier that can conveniently be mounted at the top of a ladder to permit a user to have both hands free when standing at the top of a ladder to perform trim work.

Still another object of the invention is to provide a detachable paint carrier which is inexpensive, dependable and fully effective in accomplishing its intended purposes.

BRIEF DESCRIPTION OF THE DRAWINGS

The above stated advantages and objectives of the invention, and the manner of attaining them, will become more apparent and better understood by reference to the following description of embodiments of the invention in conjunction with the accompanying drawings, wherein.

DETAILED DESCRIPTION OF THE PREFERRED EMBODIMENT

Figure 1:
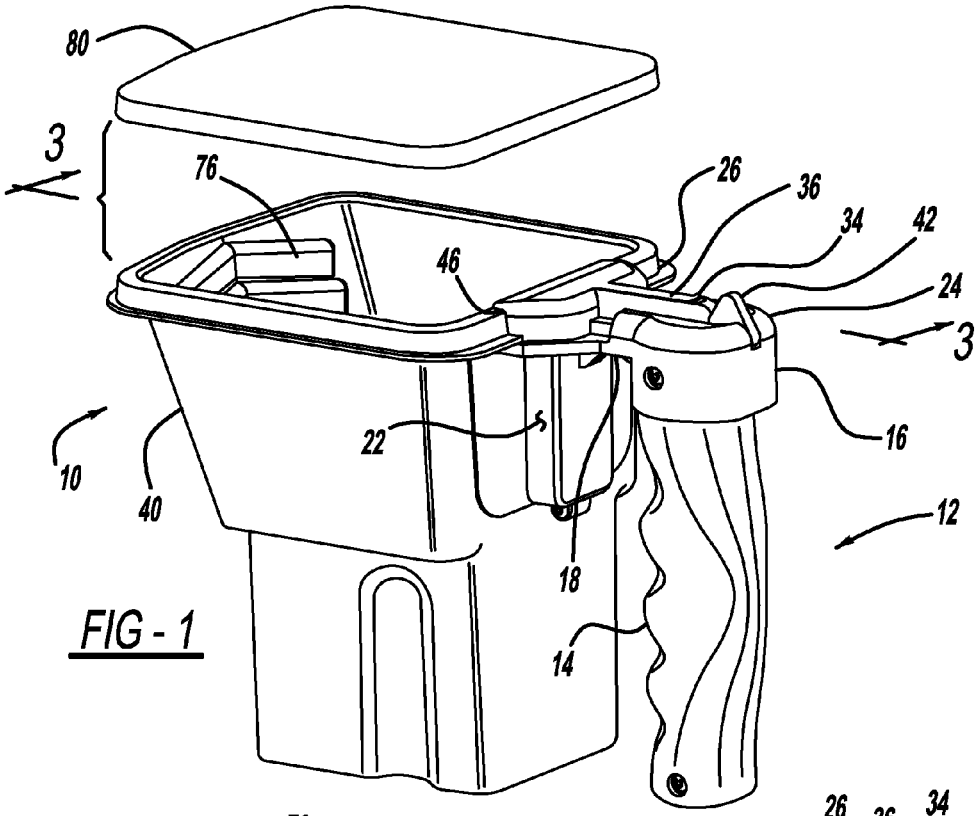
FIG. 1 is a perspective view of one embodiment of the invention.
Figure 2:
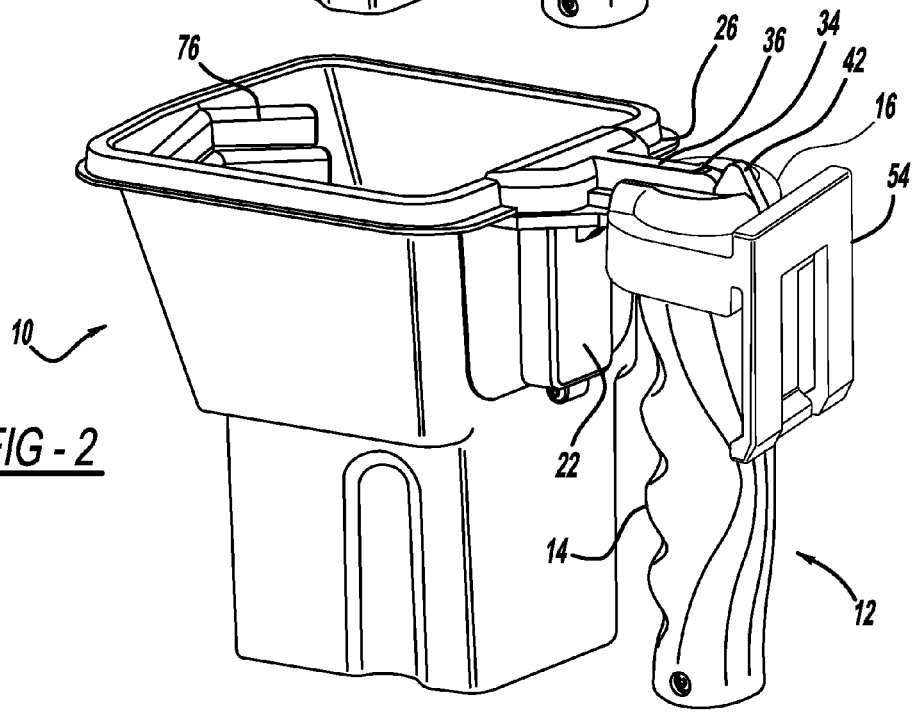
FIG. 2 is a perspective view of one embodiment of the invention showing the ergonomic detachable handle mounted to the belt clip for carrying the container while ascending or descending a ladder.
Figure 3:
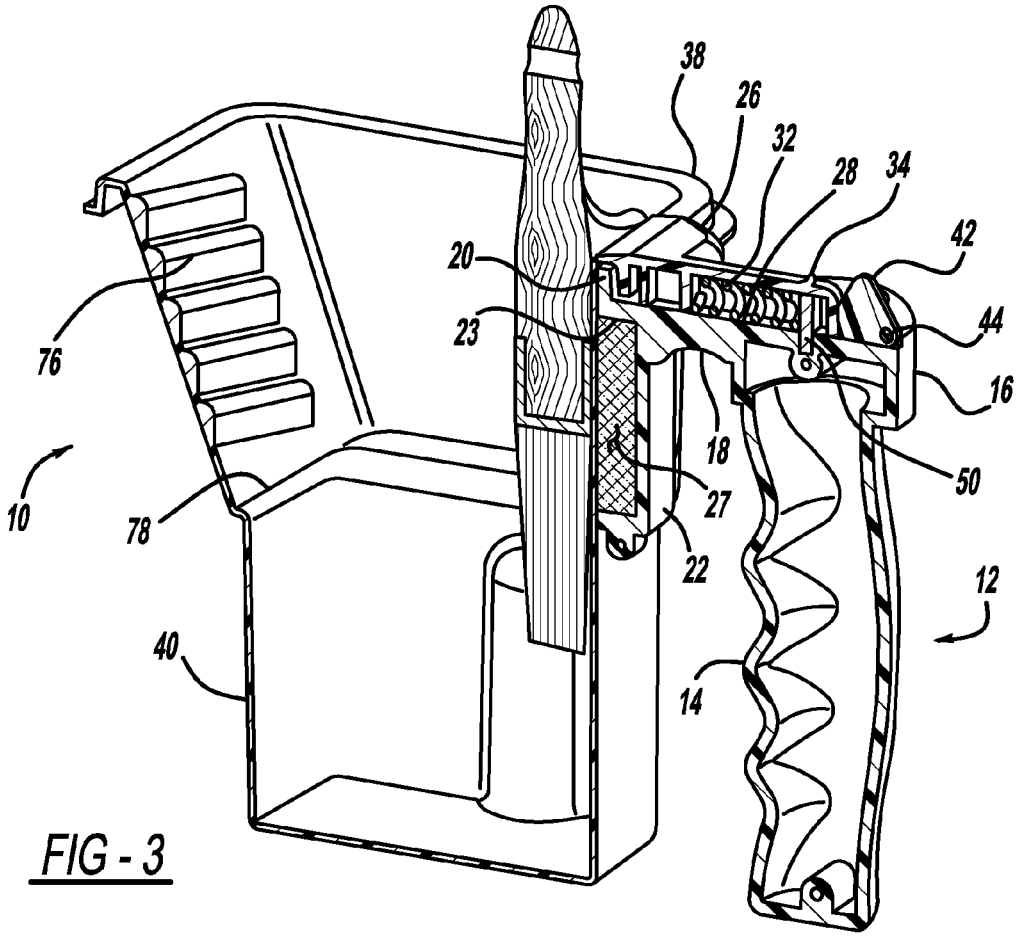
FIG. 3 is a cross-sectional view of the invention and without the belt clip taken along line 3-3 of FIG. 1 with the spring biased retainer clip and cam lock member shown in the unlocked position.

Referring now to FIGS. 1-3, there is shown in perspective, a preferred embodiment of the ergonomic detachable handle brush carrier and paint container of the present invention, generally designated as 10, which may be sized and configured for carrying any volume of paint or size of container in conjunction with providing a temporary magnetic holder for a paint brush. The term paint can or paint container is used in a broad sense herein as the invention is intended to encompass containers of other materials, for example, varnishes or stains that are provided in similar shaped containers.

The ergonomic paint can and brush carrier 10 includes a detachable handle 12 having an ergonomically designed grip portion 14 at a lower end thereof with an integrally formed contoured band 16 terminating at the upper end of the grip portion 14. The contoured band 16 has an integrally formed cantilevered platform portion 18 extending in a direction outwards of the contoured band 16 that terminates in an upstanding peripheral edge 20 as clearly shown in FIG. 3. Depending from the cantilevered end portion opposite from the upstanding peripheral edge 20 is a shell housing 22 which contains a chamber 23 for receiving a permanent magnet 27.

Figure 5:
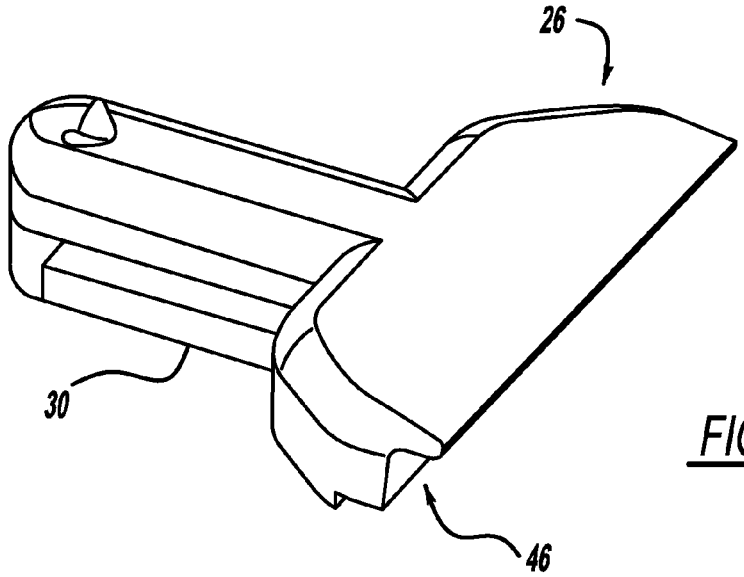
FIG. 5 is a perspective view of the spring biased retainer clip of the invention.
Figure 4:
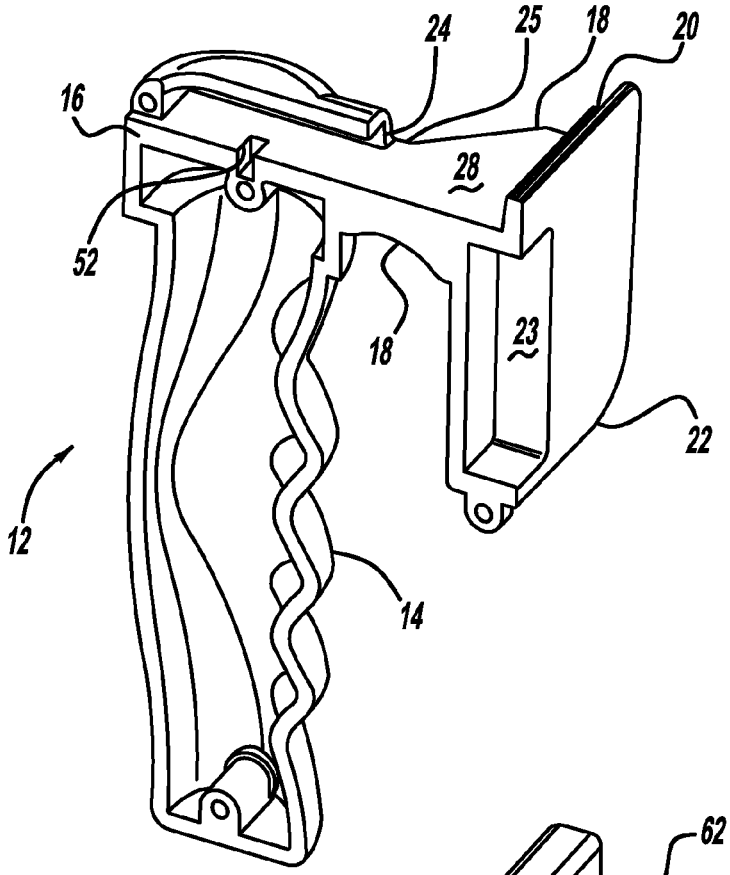
FIG. 4 is a cross-sectional perspective view of only the ergonomic handle and cantilevered support portion including the integral shell housing for receiving a permanent magnet.

Atop the contoured band 16 there is molded a pair of channel guides 24 as illustrated clearly in FIG. 4 for receiving a spring biased retainer clip 26, shown in detail in FIG. 5, that is mounted to slide along the upper surface 28 of the cantilevered platform portion 18. One end of the spring biased retainer clip 26 has an opposing set of guide rails 30 that slide within the channel guides 24 of the contoured band 16 to guide the spring biased retainer clip 26 in a linear motion in a direction towards and away from the upstanding peripheral edge 20 of the cantilevered platform portion 18. The spring biased retainer clip 26 is biased in an outward direction by a compression spring 32, shown in FIG. 3, mounted within the spring biased retainer clip 26. A ribbed projection 34 is molded on the top surface 36 of the spring biased retainer clip 26 so that a user, while holding the grip portion 14 of the detachable handle 12 can conveniently place his/her thumb of his/her hand on the ribbed projection 34 and retract the spring biased retainer clip 26 against the force of the compression spring 32 while placing the lip 38 of a container 40 over the upstanding peripheral edge 20 of the cantilevered platform portion 18 and thereafter remove his/her thumb to allow the spring biased retainer clip 26 under the influence of the spring force, to slide forward and trap the lip 38 of the container 40 between the upstanding peripheral edge 20 and the forward contoured nose portion 46 of the spring biased retainer clip 26 to attach the detachable handle 12 to the container 40.

FIG. 5 is a perspective view of the spring biased retainer clip 26 detail which, as stated above, at one end has an opposing set of guide rails 30 that slide in the channel guides 24 of the contoured band 16, and terminates at the opposite end in a contoured nose portion 46 that traps the lip 38 of the container 40 to connect the detachable handle 12 to the container 40. To ensure that the container 40 remains secured to the detachable handle 12, a small cam lock 42, shown in FIG. 3, is attached to the contoured band 16 of the detachable handle 12 with a pivot pin 44. The cam lock 42 is rotated counter-clockwise and forced against the outer surface of the spring biased retainer clip 26 to establish a frictional lock between the cam lock 42 surface and the surface of the spring biased retainer clip 26 to prevent the spring biased retainer clip 26 from retracting when the detachable handle 12 holds a container 40. When a user desires to remove the detachable handle 12 from the container 40, the cam lock 42 is rotated clockwise to unlock the spring biased retainer clip 26 and the user places his/her thumb on the ribbed projection 34 to retract the spring biased retainer clip 26. When the spring biased retainer clip 26 is retracted by a user, the lip 38 of the container 40 may be lifted off the upstanding peripheral edge 20 of the cantilevered platform portion 18 of the detachable handle 12 and the container 40 can be removed from the detachable handle 12.

With reference to FIGS. 3 and 4, there is shown an overtravel stop 50 that is securely mounted into a groove 52 clearly shown in FIG. 4 for the purpose of preventing the spring biased retainer clip 26 from traveling too far forwards when no container is attached to the detachable handle 12. The overtravel stop 50 prevents the guide rails 30 from overtraveling beyond the extent of the channel guide 24 such that once assembled, the guide rails 30 cannot accidentally be released from the channel guide 24. The overtravel stop 50 also serves as a base to which the compression spring 32 is attached to provide a biasing force in a radially outward direction to the spring biased retainer clip 26.

Figure 6:
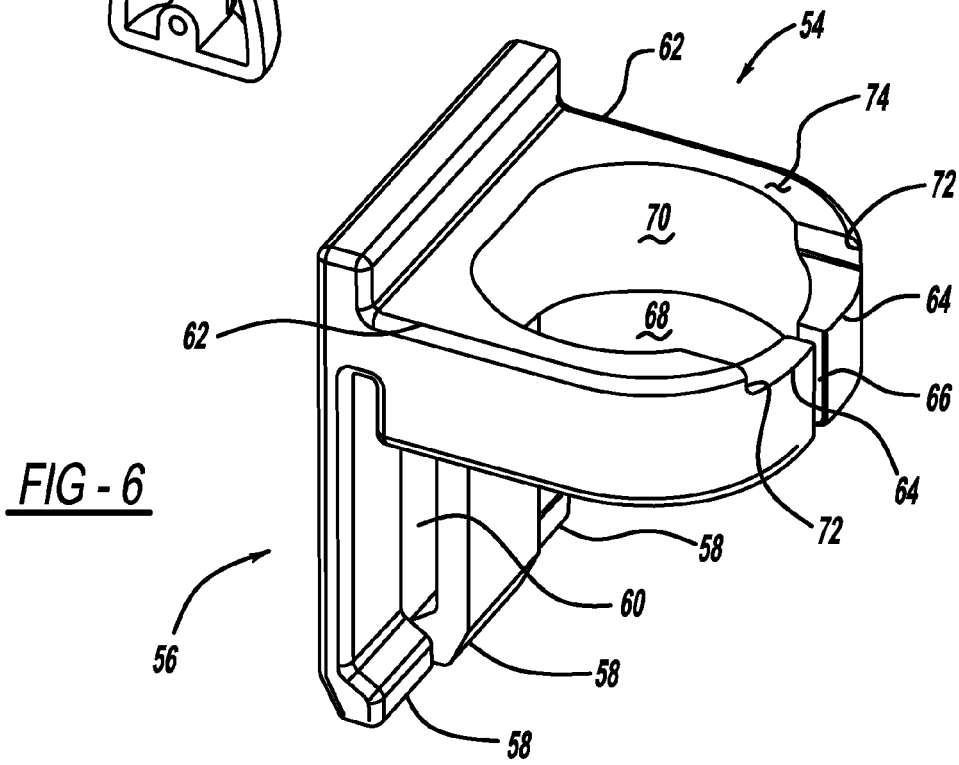
FIG. 6 is a perspective detailed view of the belt clip of the invention.

FIG. 2 illustrates the paint container and brush carrier assembly 10 with the contoured band 16 of the detachable handle 12 attached to a belt clip 54. FIG. 6 illustrates the detail of the belt clip 54. The belt clip 54 is made from a linear flat frame section 56 consisting of three elongated dependent fingers 58 arranged to circumscribe the belt (not shown) of a user. The belt may be threaded through to openings 60 or the three elongated dependent fingers 58 are elastically deformable to allow the belt to be slipped past the terminating ends of the three elongated dependent fingers 58 and to occupy the space of the openings 60. Cantilevered from the linear flat frame section 56, at an upper portion of the linear flat frame section 56, is a platform member 62 which terminates in a semi-circular peripheral wall section 64 having a vertical slit 66 therein. Approximately centrally located on the platform member 62 is a through opening 68 defined by the outer contour or the contoured band 16. The inside wall is slightly tapered so that at the bottom, the opening is smaller than the outer surface contour of the contoured band 16 while the top of the opening is somewhat larger than the contour of the contoured band 16 so that a very light interference fit is created between the outer contour of the contoured band 16 and the contour of the through opening 68 in the platform member 62.

Further, a depressed slot 72 is formed in the top surface 74 of the platform member 62. The depressed slot 72 is equally spaced about the vertical slit 66 to receive the narrowest portion 25 of the cantilevered platform portion 18 of the detachable handle 12 such that upon placing the detachable handle 12 in the through opening 68 of the belt clip 54, the narrowest portion 25 snugly fits into the depressed slot 72 and thereby prevents any rotatable movement of the detachable handle 12 and attached container 40 while the container 40 with the detachable handle 12 is attached to the belt clip 54.

Figure 7:
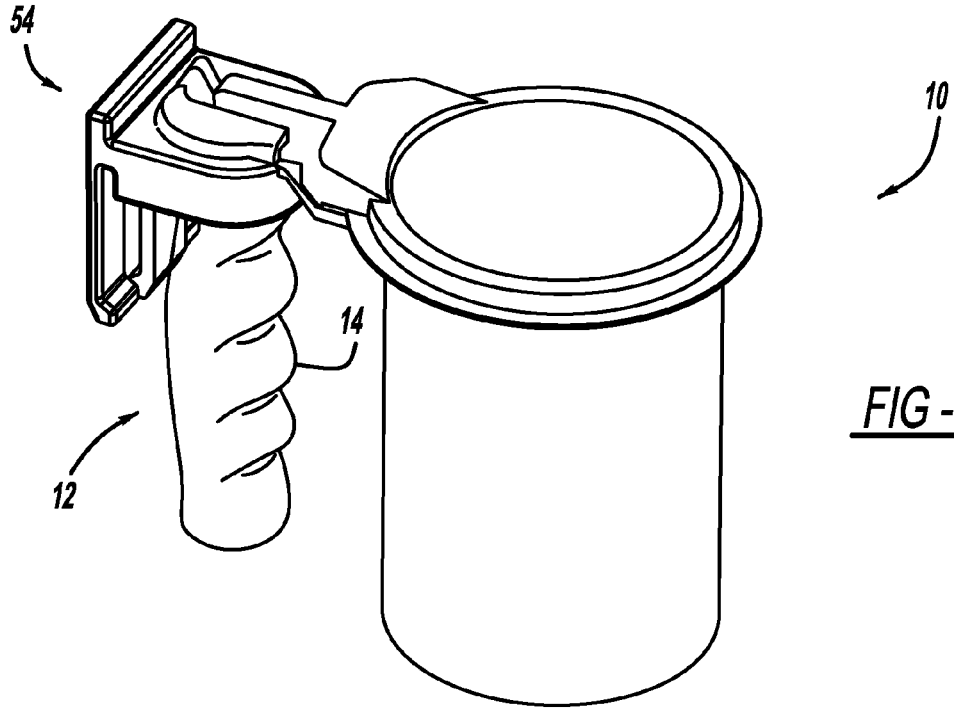
FIG. 7 is a perspective view of an alternate embodiment of the invention.

As set forth above, the invention can be used with any shaped or sized container, as illustrated in FIG. 7, wherein the detachable handle 12 is attached to a substantially circular container. Unfortunately, with such shaped container, the feature of using a permanent magnet 27 to hold the paint brush is limited. A small one inch wide brush could be held by a small magnet held in a shell housing attached to the bottom of the cantilevered platform portion 18 of the detachable handle 12. However, a wider three inch brush is better suited for the rectangular container shown in FIGS. 1-3. Also, the rectangular container illustrates a fill line for the paint level. The full level is just below the series of wiper ribs 76 to offer the user the ability to wipe the excess paint from a brush after dipping the brush into the paint within the container. The wall sections of the container above the full line are for the purpose of brush splash containment when wiping off excess paint from the brush.

As illustrated in FIG. 1, a cover is also provided to cover the container 40 once the detachable handle 12 has been removed so that the container 40 with paint therein can be stored for short periods, if necessary. It is foreseen that the container 40 is made from different materials based on its application. For example, the container 40 can be made from a high pressure plastic moldable material which can be cleaned after each use and reusable from one job to the next. The container 40 can also be made as a throw away by making the container 40 from a midgrade vacuum formed plastic material structure able to be used for a limited time and then be discarded. Further, it is also proposed to make a container from a thin vacuum formed plastic material to serve as a liner in the high pressure reusable plastic container and intended to be discarded after each use.

Figure 8:
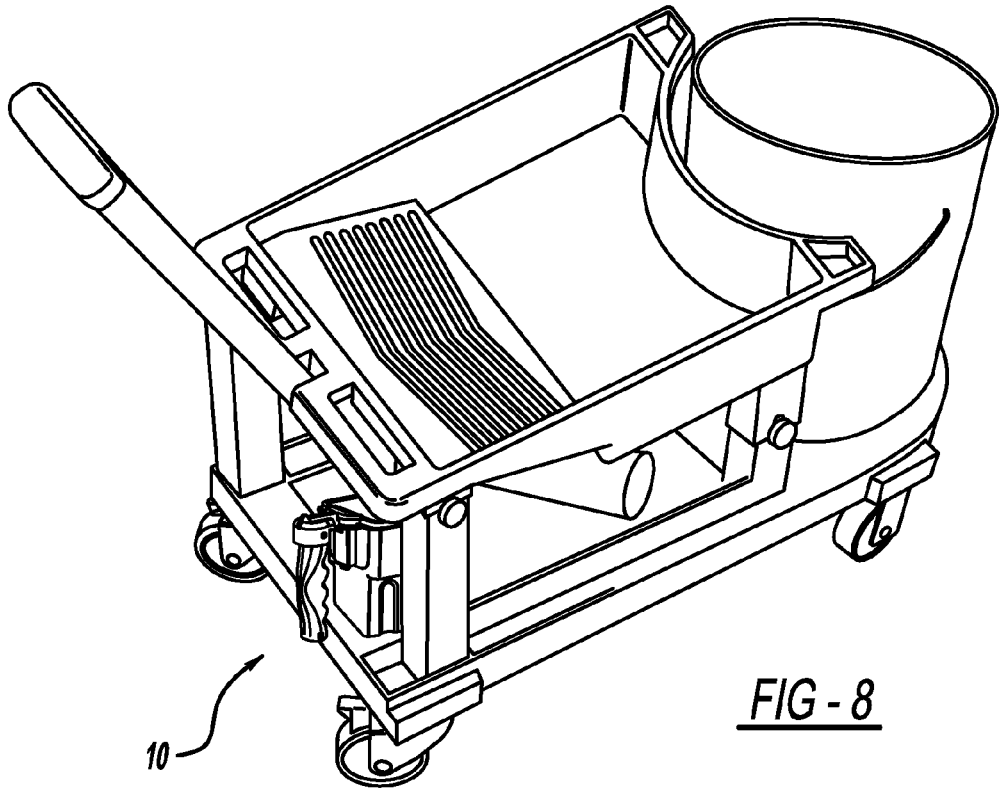
FIG. 8 is a perspective view of a painter's wheeled caddy with the inventive paint brush and paint container holder mounted in one of the storage compartments of the painter's wheeled caddy so that it may be conveniently transported about the paint site.
Figure 9:
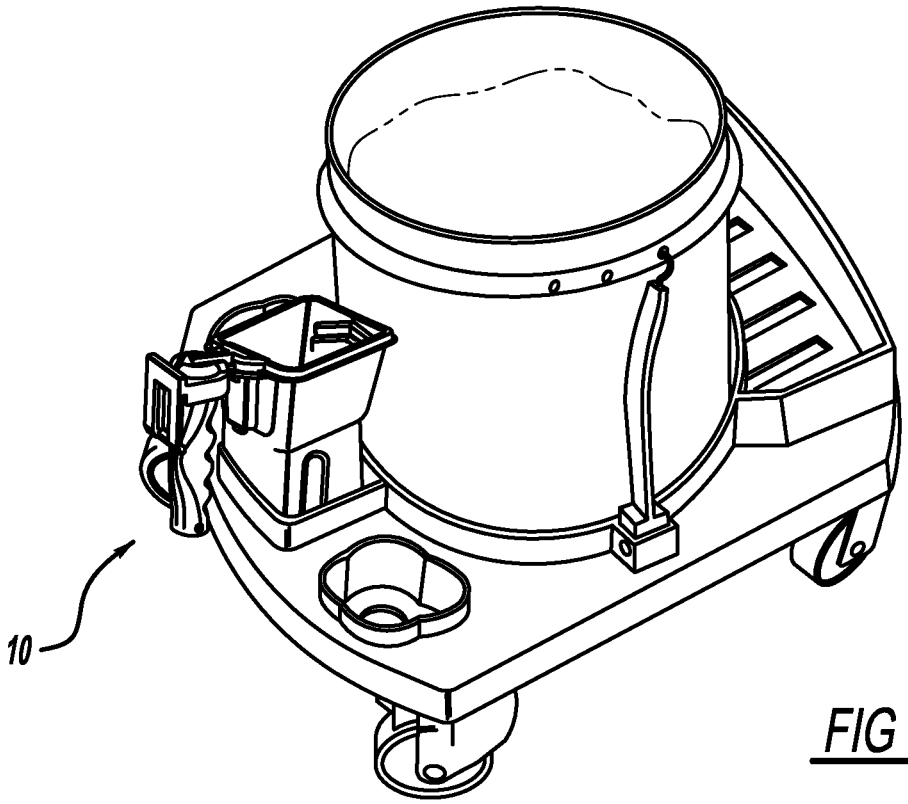
FIG. 9 is a perspective view of a single bucket caddy with the inventive paint brush and paint container holder mounted in a storage compartment of a single bucket contractor caddy which conveniently stores the paint container holder and brush and allows transportation about a worksite.

The detachable handle for a portable paint and brush container has also been designed to be used with this inventor's painter's wheeled caddy, pending U.S. patent application Ser. No. 12/207,583, filed on Sep. 10, 2008 as well as the contractor's single bucket caddy, pending U.S. patent application Ser. No. 12/481,013, filed on Jun. 9, 2009. FIGS. 8 and 9 are respective illustrations of such uses. The painter's wheeled caddy disclosed in the above application includes a lower support member with a choice of compartments. Smaller compartments at the forward end of the lower support member are provided to provide a place to store cans of cleaning products, i.e., spot cleaner, stain cleaners, primers, or degreasers. It is intended that a compartment is also provided to store the detachable handle and portable paint and brush container 10 when not in use as clearly shown in FIG. 8.

In FIG. 9, a contractor's single bucket provides a single compartment surrounding a bucket for storing the detachable handle and portable paint brush container 10 when not in use.

From the foregoing, it will be seen that the invention is one well adapted to obtain all the objects herein set forth, together with other advantages which are obvious and which are inherent to the structure.

It will be understood that certain features and sub-combinations are of utility and may be employed without reference to other features and sub-combinations. This is contemplated by and well within the scope of the claims. Although only a preferred embodiment and one variant have been shown in the drawings, many other embodiments may be made of the invention without departing from the scope thereof. It is to be understood that all matter herein set forth shown in the accompanying drawings is to be interpreted as illustrated and not in a limiting sense.

What is claimed is:

1. An ergonomic detachable handle carrying device for transporting a container, the ergonomic detachable handle carrying device being adapted to attach to a gap formed between a lip extending around an outside periphery of the container and an outer wall surface of the container, said ergonomic detachable carrying device comprising:

a) an elongated member having:

an ergonomic grip portion, and a contoured band portion at an end of the elongated member, the contoured band portion being integrally attached to the ergonomic grip portion, wherein the contoured band portion includes:

a cantilevered platform laterally extending from said contoured band portion, said cantilevered platform terminating with an upstanding peripheral edge;

a pair of channel guides mounted to the top of said contoured band portion of said ergonomic detachable carrying device and extending along the cantilevered platform; and b) means for clamping said lip of said container to said upstanding peripheral edge, said clamping meat mounted to said cantilevered platform via an opposing set of guide rails that slide in the channel guides of the cantilevered platform so that the means for clamping is adapted to laterally extend into contact with the lip of the container;

wherein the upstanding peripheral edge is adapted to extend up into the gap formed under the lip of the container so that the lip of the container is trapped between the upstanding peripheral edge and the means for clamping when the means for clamping is adapted to laterally extend into contact with the lip of the container.

2. The ergonomic detachable carrying device as claimed in claim 1 wherein said means for clamping said lip of said container to said upstanding peripheral edge further comprises:

means for biasing said means for clamping in a direction towards said container;

wherein the means for clamping includes a contoured nose portion for clamping said lip of said container to said upstanding peripheral edge of said cantilevered platform so that the container can be conveniently transported by said ergonomic carrying device; and wherein said means for clamping includes a ribbed projection on a top surface thereof such that a user can easily place his/her thumb on said ribbed projection of said retainer clip to overcome the bias of said biasing means and retract said means for clamping laterally in a direction away from said container to lift said lip of said container from said upstanding peripheral edge of said cantilevered platform thereby removing said container from said ergonomic detachable carrying device.

3. The ergonomic detachable carrying device as claimed in claim 2 further comprising means for cam locking said means for clamping in a forward direction towards said container when said lip of said container is mounted to said upstanding peripheral edge of said cantilevered platform such that when said cam locking means is rotated in a first direction said means for clamping cannot be retracted in a direction away from said container, and wherein when said cam locking means is rotated in a second opposite direction said means for clamping can be retracted laterally in a direction away from said container to lift said lip of said container from said upstanding peripheral edge of said cantilevered platform thereby removing said container from said ergonomic detachable carrying device.

4. The ergonomic detachable carrying device as claimed in claim 2 further comprising means for mounting a cam locking means to said contoured band portion.

5. The ergonomic detachable carrying device as claimed in claim 1 further comprising:

a housing shell dependent from and integrally attached to said cantilevered platform, wherein said housing shell includes:

a chamber having an opening that faces an outer wall of said container; and a permanent magnet mounted within said chamber of said housing shell, said permanent magnet having an outer surface adapted to be contiguous the outer wall of said container wherein when said means for clamping, clamps said lip of said container to said upstanding peripheral edge of said cantilevered platform, said outer surface of said permanent magnet is adapted to be intimate contact with said outer well of said container so that a magnetic field of said permanent magnet permeates said wall of said container and is adapted to act upon a metal portion of a paint brush to hold said paint brush place along an inside wall of said container when said paint brush is not in use and/or during transport of the carrying device.

6. The ergonomic detachable carrying device as claimed in claim 5 wherein said container further comprises a plurality of wiper ribs located radially opposite to said housing shell that contains said permanent magnet.

7. The ergonomic detachable carrying device as claimed in claim 1 further comprising means for attaching said ergonomic detachable carrying device to a belt worn about a waist of a workman.

8. The ergonomic detachable carrying device as claimed in claim 7 wherein said attaching means further comprises:

a belt clip for supporting said ergonomic detachable carrying device on a belt about the waist of a workman, said belt clip comprising:

a linear flat frame portion defining a plurality of dependent resilient fingers forming at least one opening for receiving the belt worn about the waist of a workman;

a platform member portion extending from said linear flat frame portion, said platform member portion having:

an upper surface; and a contoured opening in said upper surface, said contoured opening defining a wall portion having a slit therein, said wall portion further defining a recessed slot in said top surface for receiving a complimentary narrow portion of said cantilevered platform portion of said detachable carrying device when said detachable carrying device is attached to said container and supported by said belt clip while being worn about the waist of a workman.

9. The ergonomic detachable carrying device as claimed in claim 1 wherein said elongated member is made from a structural plastic material and further wherein said container further comprises a throw away liner intended to be discarded after each use.

10. An ergonomic detachable carrying device for transporting a container, the ergonomic detachable carrying device being adapted to attach to a gap formed between a lip extending around an outside periphery of the container and an outer wall surface of the container, said ergonomic detachable carrying device comprising:

a) an elongated member having:

i. an ergonomic grip portion at one end and ii. a contoured band portion, at an end opposite the ergonomic grip portion, that is integrally attached to said ergonomic grip portion, wherein the contoured band portion includes:

a cantilevered platform laterally extending from said contoured band portion, said cantilevered platform terminating with an upstanding peripheral edge;

b) means for attaching said ergonomic detachable carrying device to a belt worn about a waist of a workman;

c) a retainer clip including a pair of guide rails in an opposing relationship along peripheral sides of said retainer clip, the retainer clip mounted to a top surface of said cantilevered platform; and d) means for mounting said retainer clip to said top surface of said cantilevered platform, the means for mounting including to a pair of channel guides mounted to the top of said contoured band portion of said ergonomic detachable carrying device, the pair of guide rails connected to the pair of channel guides so that retainer clip slides laterally along the top of said cantilevered platform;

e) means far cam locking said retainer clip in a forward direction towards said container when said lip of said container is mounted to said upstanding peripheral edge of said cantilevered platform;

wherein the upstanding peripheral edge is adapted to extend up into the gap under the lip of the container so that the lip of the container is trapped between the upstanding peripheral edge and the means for clamping.

11. The ergonomic detachable carrying device as claimed in claim 10 further comprising:

a housing shell dependent from and integrally attached to said cantilevered platform, said housing shell extending parallel to said elongated member from a bottom side of said cantilevered portion;

wherein said housing shell includes:

a chamber having an opening that faces an outer wall of said container; and a permanent magnet mounted within said chamber of said housing shell, said permanent magnet having an outer surface contiguous the outer wall of said container;

wherein when said means for clamping clamps said lip of said container to said upstanding peripheral edge of said cantilevered platform, said outer surface of said permanent magnet is adapted to be in intimate contact with said outer wall of said container so that a magnetic field of said permanent magnet permeates said wall of said container and acts upon a metal portion of a paint brush to hold said paint brush in place along an inside wail of said container when said paint brush is not in use.

12. The ergonomic detachable carrying device as claimed in claim 11 wherein said container further comprises a plurality of wiper ribs located radially opposite to said housing shell that contains said permanent magnet.

13. The ergonomic detachable carrying device as claimed in claim 10 wherein said means for attaching further comprises:

a belt clip for supporting said ergonomic detachable carrying device on a belt about the waist of a workman, said belt clip comprising:

a linear flat frame portion defining a plurality of dependent resilient fingers forming at least one opening for receiving the belt worn about the waist of a workman;

a platform member portion extending from said linear flat frame portion, said platform member portion having:

an upper surface;

a contoured opening in said upper surface, said contoured opening defining a wall portion having a slit therein, said wall portion further defining a recessed slot in said top surface for receiving a complimentary narrow portion of said cantilevered platform portion of said detachable carrying device when said detachable carrying device is attached to said container and supported by said belt clip while being worn about the waist of a workman.

14. The ergonomic detachable carrying device as claimed in claim 10 wherein said means for mounting said retainer clip further comprises:

wherein said retainer clip further comprises:

a contoured nose portion, on an end of the retainer clip opposite the pair of guide rails, adapted for clamping said lip of said container to said upstanding peripheral edge of said cantilevered platform so that said container may be conveniently transported by said ergonomic carrying device;

means for biasing said retainer laterally in a direction towards said container; and a ribbed projection on a top surface of said retainer clip so that a user can easily place his/her thumb on said ribbed projection of said retainer clip to overcome the bias of said biasing means and retract said retainer clip in a direction away from said container to lift said lip of said container from said upstanding peripheral edge of said cantilevered platform thereby removing said container from said ergonomic detachable device.

15. The ergonomic detachable carrying device as claimed in claim 10 further comprising a cover mounted to said lip of said container.

16. The ergonomic detachable carrying device as claimed in claim 10 wherein said elongated member is made from a structural plastic material and further wherein said container further comprises a throw away liner intended to be discarded after each use.

17. A carrying device comprising:

a) an ergonomic detachable handle carrying device comprising:

i. an elongated member having an ergonomic grip portion;

ii. a contoured and portion located at an end of the elongated member;

iii. a cantilevered platform laterally extending from the contoured band portion;

iv. a molded pair of channel guides mounted to the top of said contoured band portion of said ergonomic detachable carrying device and extending along the cantilevered platform;

v. a spring biased retainer clip movably mounted to the cantilevered platform via an opposing set of guide rails that slide in the channel guides of the cantilevered platform so that the means for clamping is laterally extended;

vi. a shell housing extending from a bottom of the cantilevered platform parallel to the elongated member, wherein the shell housing comprises:

1) an upstanding peripheral edge on an upper surface of the shell housing;

2) a chamber having an opening facing away from the elongated member; and 3) a permanent magnet mounted within the chamber of the housing shell, the permanent magnet having an outer surface;

b) an ergonomic paint can comprising:

i. a wall having an outer wall surface and an inner wall surface; and ii. a lip extending around an outer periphery of the ergonomic paint can, wherein a gap is formed between the lip and the outer wall surface of the ergonomic paint can;

wherein the upstanding peripheral edge extends into the gap under the lip of the ergonomic paint can and the spring biased retention clip extends over a portion of the ergonomic paint can so that the lip is trapped between the upstanding peripheral edge and the spring biased retainer clip so that the ergonomic detachable handle carrying device and the ergonomic paint can are fixedly connected and the ergonomic paint can can be conveniently transported by the ergonomic detachable handle carrying device; and wherein the outer surface of the permanent magnet is contiguous with an outer wall surface of the ergonomic paint can so that a magnetic field of the permanent magnet permeates the wall of the ergonomic paint can so that the magnetic field is adapted to act upon a metal portion of a paint brush to hold the paint brush in place along the inner wall surface of the an ergonomic paint can when the paint brush is not in use and/or during transport of the ergonomic paint can.

18. The carrying device of claim 17, wherein the ergonomic paint can includes a plurality of wiper ribs located on the wall surface of the ergonomic paint can opposite to the inner wall surface proximate to the permanent magnet.

19. The carrying device of claim 18, wherein the ergonomic detachable handle carrying device comprises:

a contoured nose portion, on an end of the retainer clip opposite the pair of guide rails, for clamping said lip of said container to said upstanding peripheral edge of said cantilevered platform, wherein the contoured nose cone portion engages an upper surface of the lip of the ergonomic paint can without extending into an open space in the ergonomic paint can so that the ergonomic paint can may be conveniently transported by said ergonomic carrying device;

a spring for biasing said spring biased retainer clip laterally in a direction towards the lip of the ergonomic paint can; and a ribbed projection on a top surface of the spring biased retainer clip so that a user can easily place his/her thumb on said ribbed projection of said retainer clip to overcome the bias of the spring and retract the spring biased retainer clip in a direction away from the ergonomic paint can to lift the lip of the ergonomic paint can from the upstanding peripheral edge of said cantilevered platform thereby removing the ergonomic paint can from the ergonomic detachable handle carrying device.

20. The carrying device as claimed in claim 17, wherein the ergonomic paint can comprises a cover mounted to the lip of the ergonomic paint can.

* * * * *

UNITED STATES PATENT AND TRADEMARK OFFICE

CERTIFICATE OF CORRECTION

PATENT NO. : 8,505,788 B2
APPLICATION NO. : 12/765173
DATED : August 13, 2013
INVENTOR(S) : Thibault It is certified that error appears in the above-identified patent and that said Letters Patent is hereby corrected as shown below:

Title Page

Item (56) Col. 2, lines 4 and 18,
References Cited
U.S. PATENT DOCUMENTS
2,648,900 A 8/1953 Anderson, delete "2,648,900" and insert --6,648,900--
3,261,635 A 7/1996 Talay, delete "3,261,635" and insert --3,291,635--

Page 2,
Item (56) Col. 2, lines 30 and 32,
7,543,726 B2 6/2009 MacNaughton, delete "7,543,726" and insert --7,543,729--
7,604,270 B1 10/2009 McCarthy, delete "7,604,270" and insert --7,604,207--

In the Claims

Col. 7, Claim 1, line 50, "said clamping meat", delete "meat", insert --means--
Col. 8, Claim 3, line 21, "cannot be retracted in a", insert --laterally-- after "retracted"
Col. 8, Claim 5, line 48, "with said outer well of", delete "well", insert --wall--
Col. 10, Claim 11, line 16, "inside wail of said", delete "wail", insert --wall--
Col. 11, Claim 17, line 11, "a contoured and portion", delete "and", insert --band--

Signed and Sealed this
Fifteenth Day of October, 2013

Teresa Stanek Rea

Teresa Stanek Rea
*Deputy Director of the United States Patent and Trademark Office*